US007532736B2

(12) United States Patent
Funahashi

(10) Patent No.: US 7,532,736 B2
(45) Date of Patent: May 12, 2009

(54) SPEAKER

(75) Inventor: Osamu Funahashi, Osaka (JP)

(73) Assignee: Panasonic Corporation, Osaka (JP)

( * ) Notice: Subject to any disclaimer, the term of this patent is extended or adjusted under 35 U.S.C. 154(b) by 459 days.

(21) Appl. No.: 10/568,278

(22) PCT Filed: Aug. 2, 2005

(86) PCT No.: PCT/JP2005/014069

§ 371 (c)(1),
(2), (4) Date: Feb. 15, 2006

(87) PCT Pub. No.: WO2006/022119

PCT Pub. Date: Mar. 2, 2006

(65) Prior Publication Data

US 2006/0285718 A1 Dec. 21, 2006

(30) Foreign Application Priority Data

Aug. 27, 2004 (JP) ..... 2004-248046

(51) Int. Cl.
*H04R 1/02* (2006.01)
*H04R 9/06* (2006.01)
*H04R 11/02* (2006.01)

(52) U.S. Cl. ..... 381/412; 381/404; 381/399

(58) Field of Classification Search ..... 381/189, 381/396–398, 403, 404, 407, 412, 419, 423–428, 381/431; 181/163–165, 171–173
See application file for complete search history.

(56) References Cited

U.S. PATENT DOCUMENTS

| | | | | |
|---|---|---|---|---|
| 5,847,333 | A | 12/1998 | D'Hoogh | |
| 6,243,479 | B1 * | 6/2001 | Proni | 381/420 |
| 6,829,366 | B2 * | 12/2004 | Tanabe | 381/412 |
| 2003/0185415 | A1 | 10/2003 | Funahashi et al. | |
| 2004/0165746 | A1 * | 8/2004 | Kreitmeier et al. | 381/398 |
| 2006/0215871 | A1 | 9/2006 | Funahashi et al. | |

FOREIGN PATENT DOCUMENTS

| | | |
|---|---|---|
| JP | 08-307990 | * 11/1996 |
| JP | 11-275690 | 10/1999 |
| JP | 2003-264891 | 9/2003 |
| JP | 2004-007333 | 1/2004 |
| JP | 2004-007335 | 1/2004 |
| WO | 2002/102113 | 12/2002 |

* cited by examiner

*Primary Examiner*—Brian Ensey
(74) *Attorney, Agent, or Firm*—Wenderoth, Lind & Ponack, L.L.P.

(57) ABSTRACT

A speaker including a frame, a diaphragm fixed to the frame through a first edge, a voice coil, a magnetic circuit, and a suspension holder fixed to the frame through a second edge is disclosed. The first and the second edges are spaced apart, and substantially symmetrical in shape with respect to the space between them. The inner periphery of the suspension holder and the inner periphery of the diaphragm are fixed to a part of the voice coil which is located outside of the magnetic gap of the magnetic circuit. The magnetic circuit has a magnet provided outside of the bottom of the frame. The outer periphery of the magnetic extends at least beyond the center of the second edge. The magnetic gap of the magnetic circuit is disposed inside of the frame, above a bottom surface of the frame.

9 Claims, 6 Drawing Sheets

FIG. 4
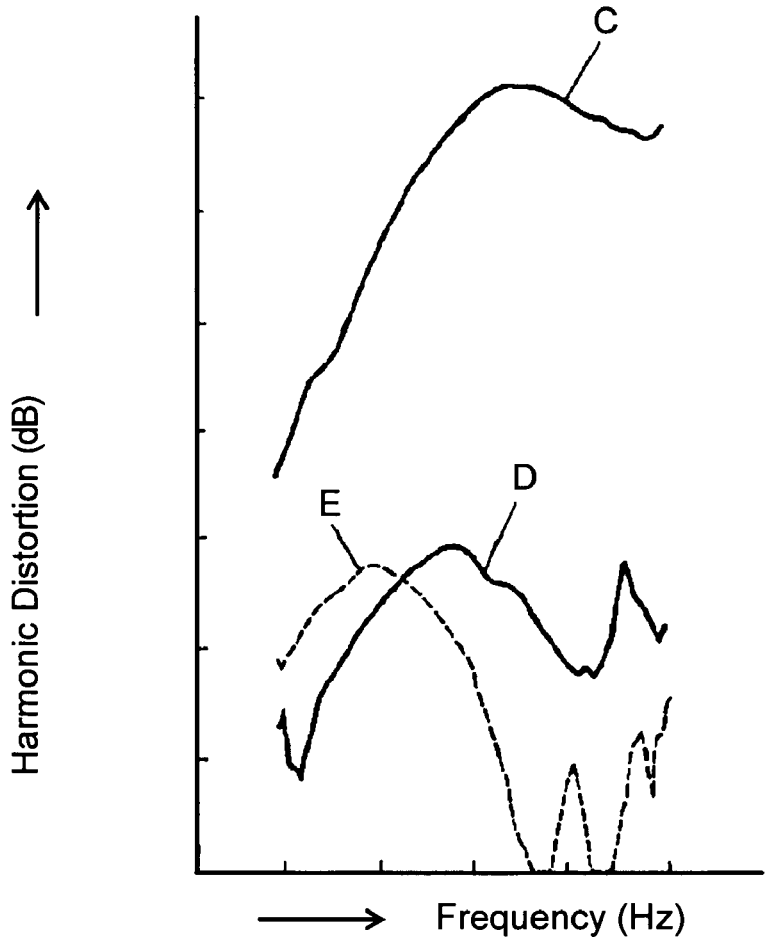
FIG. 5 – PRIOR ART
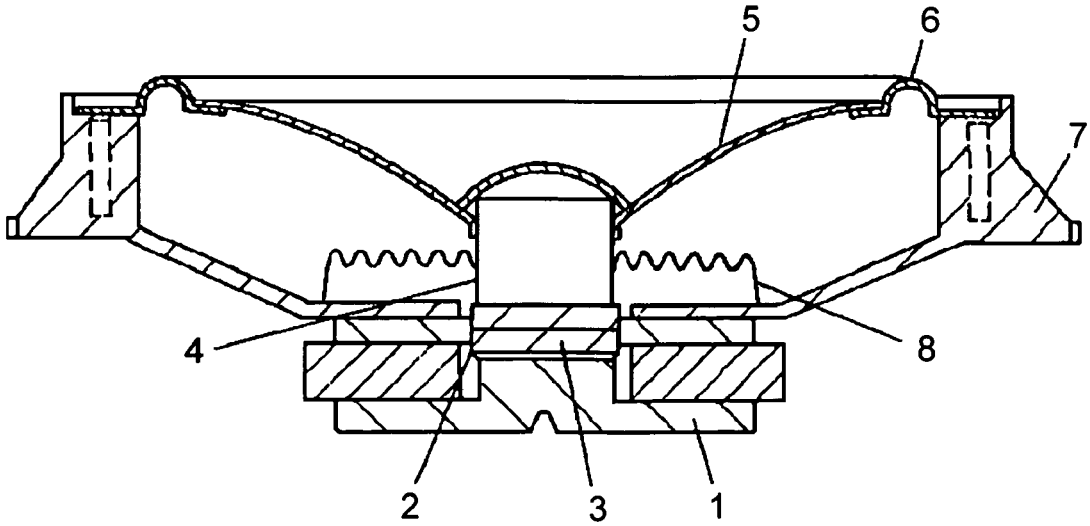

FIG. 6 – PRIOR ART
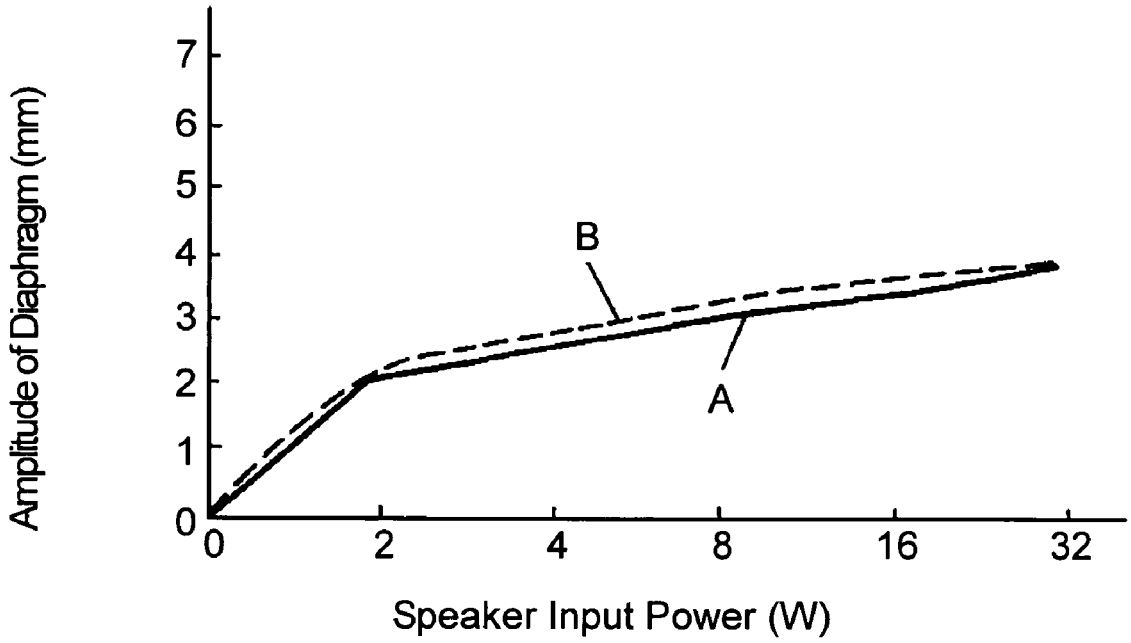

FIG. 7 – PRIOR ART
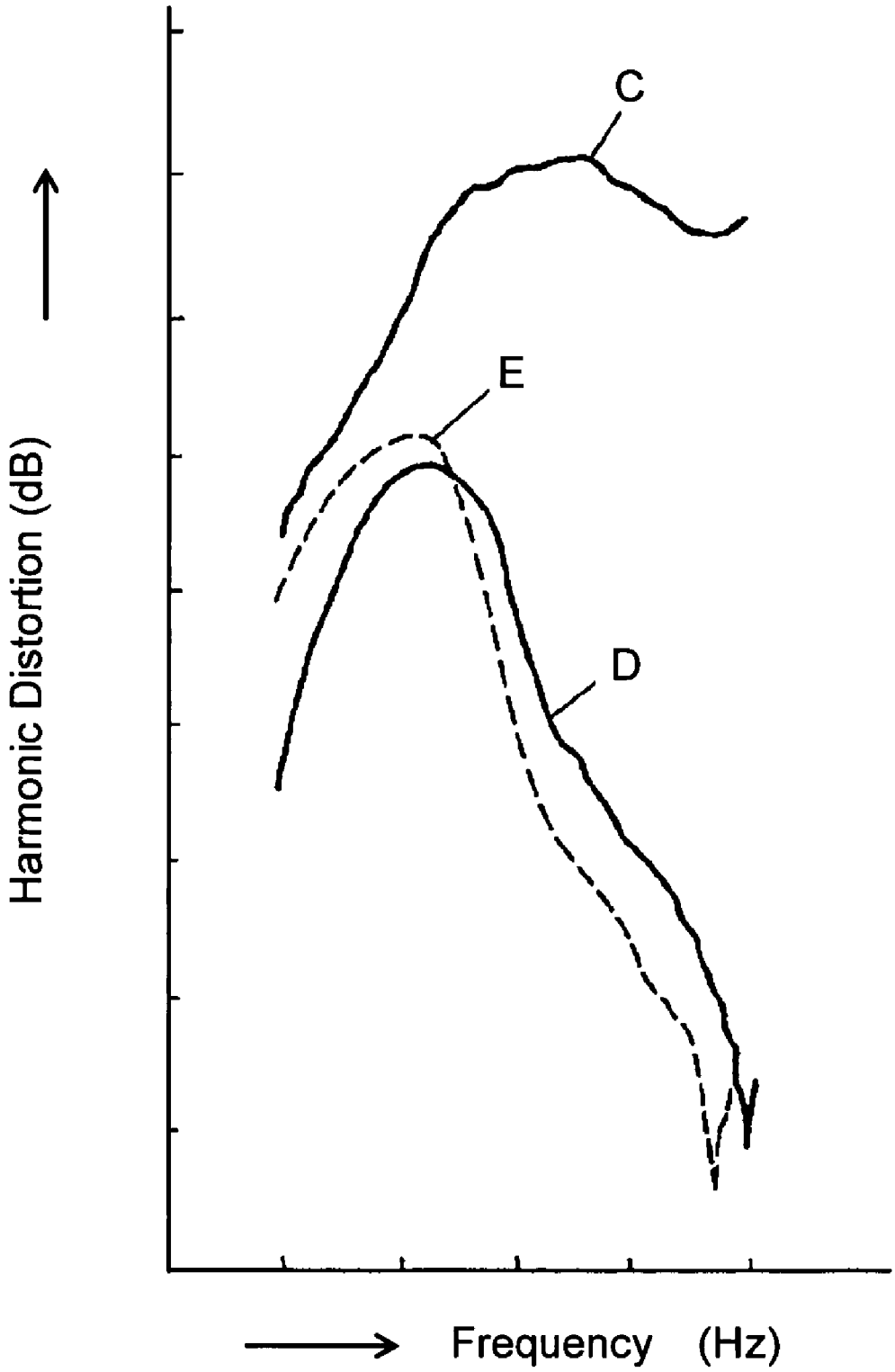

SPEAKER

This application is a U.S. National Phase application of PCT International Application PCT/JP2005/014069.

BACKGROUND OF THE INVENTION

1. Field of the Invention

The present invention relates to speakers for use in various acoustic systems.

2. Description of the Related Art

A description of the structure of a conventional speaker will be given referring to FIG. 5. This speaker has magnetic circuit 1; a voice coil 4, of which at least coil section 3 is movably provided inside magnetic gap 2 of magnetic circuit 1; a diaphragm 5, the inner periphery of which being coupled to an external part of magnetic gap 2 of magnetic circuit 1; and a frame 7 to which the outer periphery of diaphragm 5 is coupled through edge 6. By inputting an electric signal fed from an audio amplifier and the like to coil section 3 of voice coil 4, voice coil 4 is excited, the force of excitation is transmitted to diaphragm 5, and diaphragm 5 converts the electric signal into a sound by vibrating air. An example of a speaker having such a structure is disclosed in Japanese Patent Unexamined Publication No. H11-275690.

In the above-described conventional example, as shown in FIG. 5, the inner periphery of damper 8 is fixed between coil section 3 of voice coil 4 and a section of voice coil 4 where the inner periphery of diaphragm 5 is fixed, and the outer periphery of damper 8 is fixed to frame 7. Damper 8 forms a suspension jointly with edge 6 and prevents voice coil 4 from rolling when in motion. Also, damper 8 is formed in the shape of two or more waveforms combined in order to minimize the mechanical load to voice coil 4.

However, according to a recent trend toward higher performance of speakers, the existence of damper 8 is causing serious problems.

That is, due to a large degree of non-linearity of mechanical load and asymmetry between the behavior of voice coil 4 moving toward magnetic circuit 1 and the behavior of the voice coil moving toward a direction opposite to magnetic circuit 1, there is a possibility of generating large harmonic distortion and, at the same time, worsening power linearity.

FIG. 6 shows power linearity of a conventional speaker, namely, amplitude (displacement) of diaphragm 5 as a function of input power to the speaker. In the Figure, curve A represents the amplitude characteristic of diaphragm 5 moving toward magnetic circuit 1 while curve B represents the amplitude characteristic of diaphragm 5 toward a direction opposite to magnetic circuit 1. Also, FIG. 7 shows the harmonic distortion characteristic of a conventional speaker. In the Figure, curve C, curve D, and curve E, respectively, represent the first harmonic distortion, second harmonic distortion characteristic, and third harmonic distortion characteristic of the speaker.

In order to solve such problems of power linearity and harmonic distortions, various studies are being made to improve non-linearity and asymmetry of damper 8. As has been described above, damper 8 is structured by combining two or more waveforms in order to minimize mechanical load. Accordingly, in so far as a suspension is to be structured by combining damper 8 and edge 6, it is difficult to reduce harmonic distortions by solving the problems of non-linearity and asymmetry, and enhancement of speaker performance is not satisfactory.

Therefore, a structure has been proposed in recent years in which damper 8 is removed and, instead, a ring-shaped suspension holder 8*a* is provided underneath diaphragm 5 as shown in FIG. 8 The inner periphery of suspension holder 8*a* is fixed to voice coil 4, and the outer periphery of suspension holder 8*a* is fixed to frame 7 through second edge 6*a*. Edge 6 and second edge 6*a* are made substantially symmetrical with respect to a space in between. That is, when edge 6 is upwardly protruding as shown in FIG. 8, second edge 6*a* is made to be downwardly protruding. With this structure, load unbalance in the vertical motion of diaphragm 5 associated with the shapes of the protrusion of both edges is cancelled, and worsening of power linearity is suppressed. This is an effort of making the two displacements of diaphragm 5 as shown by curves A and B in FIG. 6 identical.

However, there are problems to be solved with the speaker shown in FIG. 8. That is, as second edge 6*a* is provided, the magnetic circuit 1 has to be provided inward of second edge 6*a*. As a result, magnet 1*a* of magnetic circuit 1 becomes smaller, making the driving force of voice coil 4 smaller and presenting the possibility of smaller audio output.

SUMMARY OF THE INVENTION

The present invention provides a speaker that includes a concave frame having an opening on the upper side, a diaphragm provided in the opening of the frame with its outer periphery fixed to an edge portion of the opening of the frame through a first edge, a voice coil provided on the bottom surface side of the diaphragm, a magnetic circuit in which at least a part of the voice coil is movably provided in the magnetic gap, and a suspension holder having an outer periphery which is fixed to the frame through a second edge on the bottom surface of the diaphragm within the frame. The first and the second edges are symmetrical in shape with respect to a space in between, and the inner periphery of the suspension holder and the inner periphery of the diaphragm are directly or indirectly fixed to the voice coil at a part outside of the magnetic gap. The magnetic circuit has a magnet provided outside of the bottom of the frame, and the outer periphery of the magnet extends at least beyond the center of the second edge. The magnetic gap of the magnetic circuit is pushed into the frame past the bottom surface of the frame. As a result, the speaker of the present invention provides lower distortion and increased audio output.

BRIEF DESCRIPTION OF THE DRAWINGS

FIG. 4 is a graph showing the harmonic distortion characteristic of the speaker shown in FIG. 1.

FIG. 5 is a cross-sectional view of a conventional speaker.

FIG. 6 is a graph showing the power linearity of the conventional speaker.

FIG. 7 is graph showing the harmonic distortion of the conventional speaker.

REFERENCE NUMERALS IN THE DRAWINGS

| | |
|---|---|
| 9 | Frame |
| 10 | Diaphragm |
| 11 | First edge |
| 12 | Voice coil |
| 13 | Coil section |
| 14 | Magnetic gap |
| 15 | Suspension holder |
| 16 | Second edge |
| 17 | Magnetic circuit |
| 18 | Magnet |
| 19 | Columnar projection |
| 20 | Yoke |
| 21 | Ring-shaped plate |
| 22 | Step section |
| 23 | Air vent |
| 24 | Dust filter |
| 25 | Top plate |

DETAILED DESCRIPTION OF THE INVENTION

The speaker of the present invention has the following structure. The speaker includes a concave frame having an opening on the upper side, a diaphragm provided in the opening of the frame with its outer periphery fixed to the edge of the opening of the frame through a first edge, a voice coil provided on the bottom side of the diaphragm, a magnetic circuit into a magnetic gap of which at least a part of the voice coil is movably disposed, and a suspension holder having an outer periphery of being is fixed to the frame through a second edge on the bottom side of the diaphragm within the frame. The first and the second edges are substantially symmetrical with respect to a space in between. The magnetic circuit has a magnet provided outside of the bottom of the frame with its outer periphery extending to at least beyond the center of the second edge. The magnetic gap of the magnetic circuit passes through the bottom of the frame and reaches inside of the frame.

In this way, as the voice coil of the speaker of this invention is supported by the diaphragm, the suspension holder, and the first and the second edges which are substantially symmetrical with respect to a space in between, smooth vertical motion of the diaphragm is made possible and the distortion of sound reproduction can be reduced. Also, as a larger magnet can be used in the speaker of the present invention, the driving force of the voice coil can be increased and the audio output can be increased.

A description of an exemplary, preferred embodiment of the present invention will be given below referring to drawings. The present invention is not limited to this exemplary embodiment. The drawings are schematic and do not represent dimensionally correct positional relationships.

Figure 1:
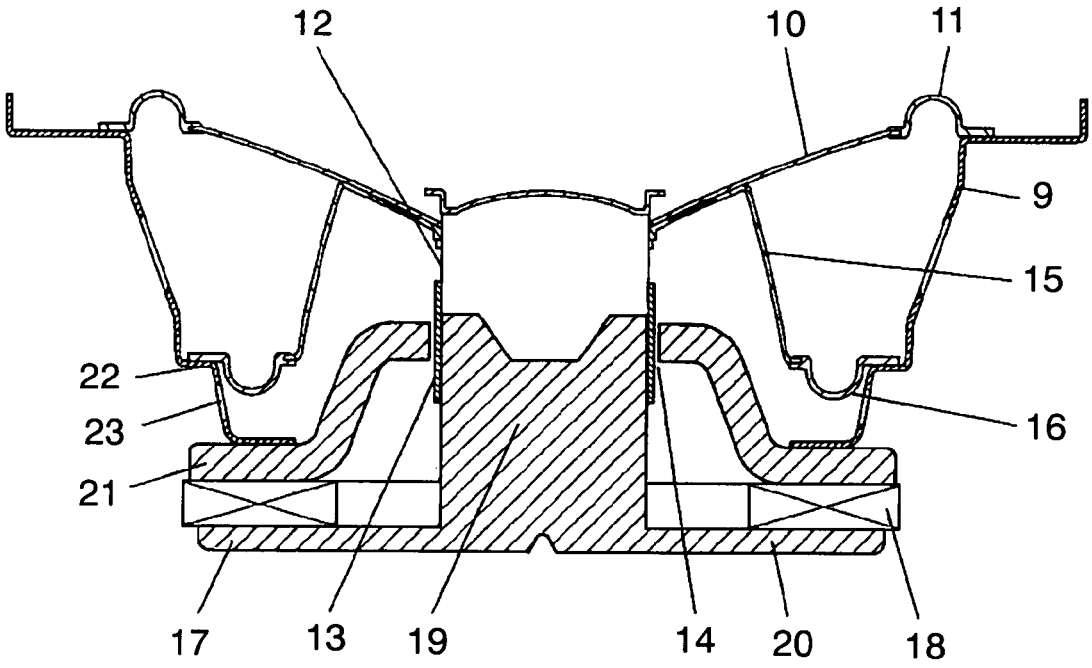
FIG. 1 is a cross-sectional view of a speaker according to a preferred embodiment of the present invention.

A description of this preferred embodiment will be described referring to FIG. 1 to FIG. 4. As shown in FIG. 1, concave frame 9 has an opening on the upper side and is formed by drawing a metal plate into a concave shape. Also, circular ring-shaped diaphragm 10 is provided in the upper opening of frame 9. The outer periphery of diaphragm 10 is fixed to an edge section of the opening of frame 9 through ring-shaped first edge 11 made of rubber.

Cylindrical voice coil 12 is provided on the bottom side of diaphragm 10. At least lower coil section 13 of voice coil 12 is disposed in a vertically movable fashion in magnetic gap 14. The outer periphery of cylindrical trapezoidal suspension holder 15 is fixed to frame 9 through ring-shaped second edge 16 made of rubber on the bottom surface side of diaphragm 10 inside frame 9.

First edge 11 and second edge 16 are substantially symmetrical with respect to a space in between. To be more specific, first edge 11 upwardly protrudes in the form of a semicircle, while second edge 16 downwardly protrudes in the form of a semicircle. Also, the overlapping portions of the inner periphery of suspension holder 15 and the inner periphery of diaphragm 10 are integrated with an adhesive, and are further directly or indirectly fixed with an adhesive to a part outside of magnetic gap 14 of voice coil 12.

Here, a description will be given on the point of directly or indirectly fixing in the present invention. As shown in FIG. 1, the inner periphery of suspension holder 15 and the inner periphery of diaphragm 10 are integrated and are directly fixed to the outer periphery of voice coil 12. Furthermore, the inner periphery of either, for example, diaphragm 10, may be fixed to the outer periphery of voice coil 12, and the inner periphery of suspension holder 15 may be made smaller than shown in FIG. 1 and fixed to the bottom surface of diaphragm 10 with an adhesive. Conversely, the inner periphery of suspension holder 15 may be fixed to the outer periphery of voice coil 12, and the inner periphery of diaphragm 10 may be made smaller than shown in FIG. 1 and fixed to the top surface of suspension holder 15 with an adhesive. These are the states in which either suspension holder 15 or diaphragm 10 is indirectly fixed to the outer periphery of voice coil 12.

Now, magnetic circuit 17 for forming magnetic gap 14 is provided outside of the bottom of frame 9 as shown in FIG. 1 and, at the same time, has a magnet 18 having an outer periphery extending to at least beyond the center of second edge 16. Magnetic circuit 17 comprises yoke 20 having columnar protrusion 19 formed on the upper surface of a disc-like member, ring-shaped magnet 18 laminated on top of yoke 20, and ring-shaped plate 21. Ring-shaped plate 21 has an outer periphery which is laminated on top of magnet 18, and an inner periphery which is pushed into frame 9 together with columnar protrusion 19 of yoke 20, so as to form magnetic gap 14 in the space between itself and columnar protrusion 19. Magnetic gap 14 passes through the bottom of frame 9 and reaches the central part within frame 9.

Figure 2:
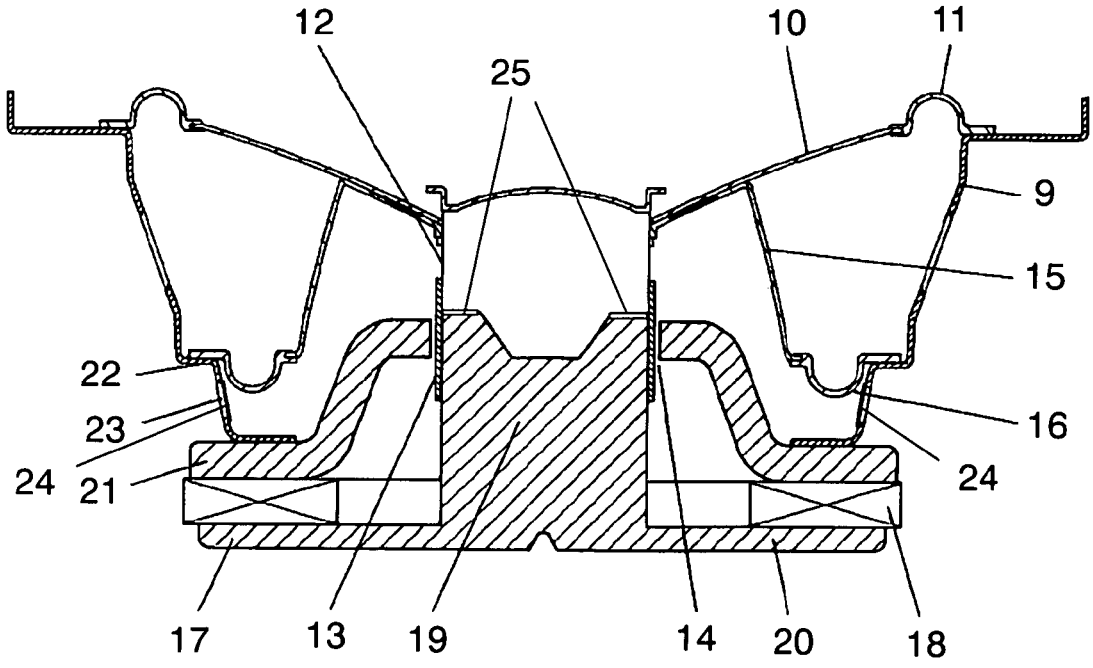
FIG. 2 is a cross-sectional view of a speaker according to another preferred embodiment of the present invention.

In magnetic circuit 17, disk-like yoke 20, ring-shaped magnet 18 and ring-shaped plate 21 are integrated into one piece by gluing and are secured to a part outside of the bottom surface of frame 9 with a bolt (not shown) and the like. Also, as shown in FIG. 2, magnetic gap 14 may be formed between the outer periphery of top plate 25 and ring-shaped plate 21 after laminating top plate 25 on columnar protrusion 19 of yoke 20.

Also, step portion 22 is formed on a lower part on the side of frame 9 for fixing second edge 16 with an adhesive. Air vent 23 is formed on a side surface of frame 9 lower than step portion 22. Though air vent 23 is formed for ventilation, it is preferable to provide dust filter 24, as shown in FIG. 2, in order to prevent dust from entering into magnetic gap 14 through air vent 23. When doing this, dust filter 24 may be provided on the outside of frame 9 of air vent 23. Such arrangement can prevent dust filter 24 from blocking vertical motion of second edge 16.

As the size of magnet 18 of magnetic circuit 17 can be made so large that the outer periphery of magnetic 18 extends beyond second edge 16 as shown in FIG. 1, the driving force of voice coil 12 can be further increased by doing so.

In this preferred embodiment, a suspension consisting of suspension holder 15 and second edge 16 is provided between voice coil 12 and frame 9 in place of a conventional damper.

Figure 3:
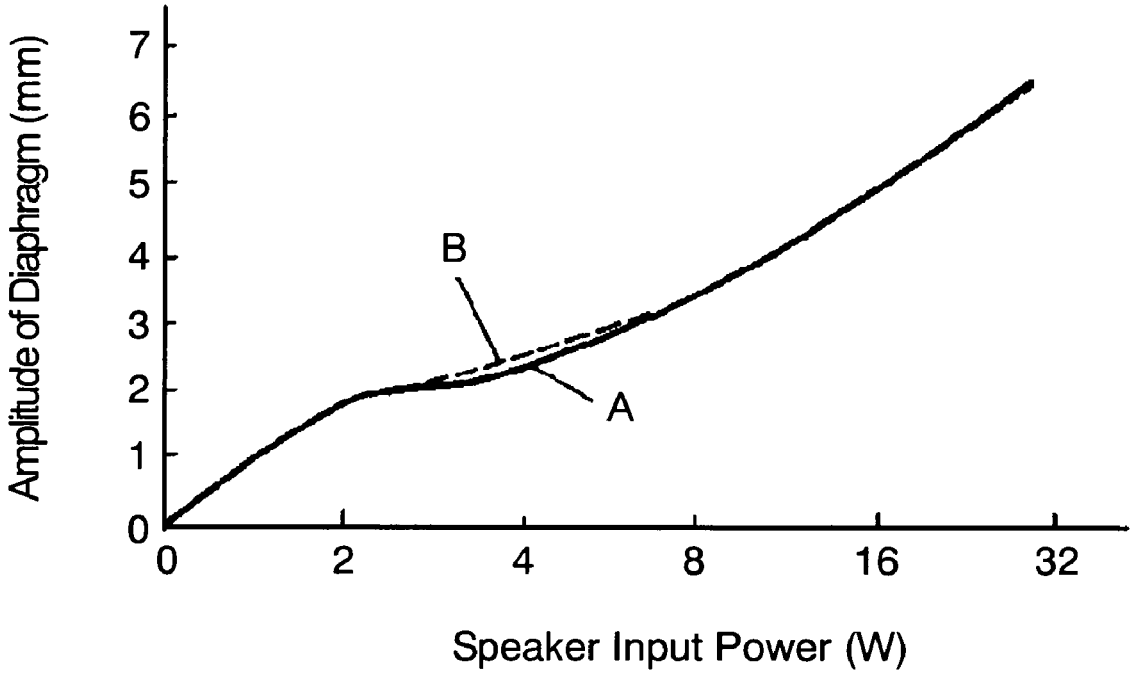
FIG. 3 is a graph showing the power linearity of the speaker shown in FIG. 1.
Figure 8:
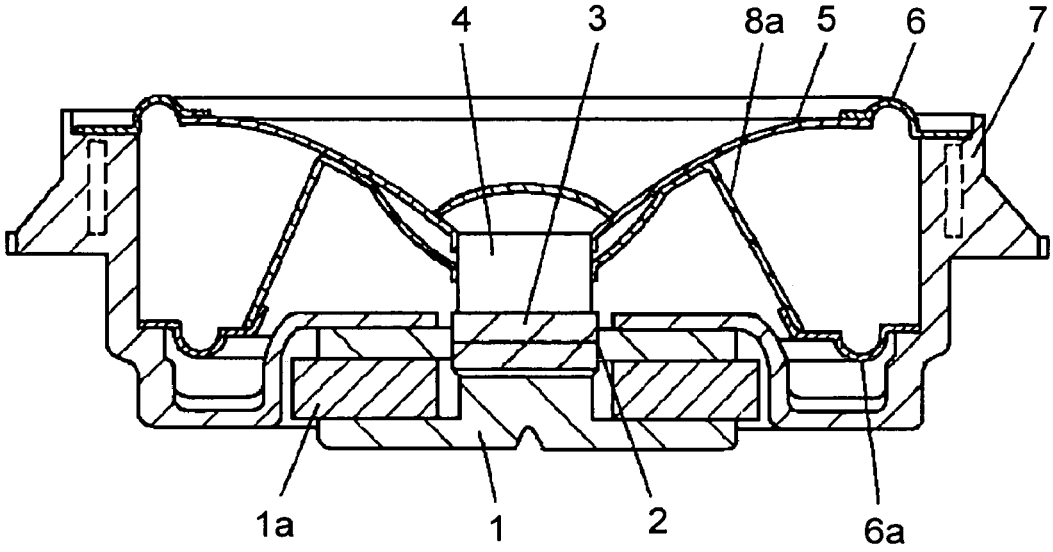
FIG. 8 is a cross-sectional view of another conventional speaker.

Suspension holder 15 and second edge 16 make up the suspension jointly with first edge 11, and are provided to prevent voice coil 12 from rolling when voice coil 12 moves vertically. Consequently, the suspension can be structured with first edge 11 and second edge 12, and a damper which might cause non-linearity and asymmetry of a suspension can be removed. Also, first edge 11 and second edge 16 are of substantially symmetrical and analogous in shape so as to cancel intrinsic asymmetry. In other words, first edge 11 and second edge 16 are oppositely disposed in so that the directions of their protrusions are opposite. Thus, the two curves, A and B, in FIG. 3 showing power linearity are substantially identical. That is, the problems of non-linearity and asymmetry of the suspension can be basically solved in this way.

In addition, since harmonic distortions, such as the second and third harmonic distortion characteristics of a speaker shown by curves D and E in FIG. 4, attributable to non-linearity and asymmetry of the suspension can be reduced, performance of the speaker can be enhanced.

The magnetic and structural materials employed in the magnetic circuit of the present invention may be any materials usually used by those skilled in the art.

The present invention provides a speaker having small vibration distortion of the diaphragm yet having a large voice coil driving force. The speaker can be widely used in a variety of acoustic systems.

The invention claimed is:

1. A speaker comprising:

a concave frame having a lower surface on a lower portion thereof, and an opening on an upper portion thereof;

a diaphragm having an inner periphery, an outer periphery, and a bottom surface, said diaphragm disposed in said opening of said frame and fixed to an edge of said opening by a first edge;

a voice coil on said bottom surface of said diaphragm;

a suspension holder having an inner periphery and an outer periphery, said suspension holder disposed inside of said frame at said bottom surface of said diaphragm and fixed to said frame by a second edge; and a magnetic circuit including:

a yoke having a columnar protrusion extending from an upper surface of a plate member, a ring-shaped magnet having an outer periphery, said magnet laminated on said yoke; and a ring-shaped plate having an inner periphery, and an outer periphery laminated on said ring-shaped magnet;

wherein:

said first and second edges are spaced apart, and substantially symmetrical with respect to a space therebetween;

at least a portion of said magnetic circuit is disposed outside of said frame and below said lower surface of said frame;

said outer periphery of said ring-shaped magnet extends beyond a center of a width of said second edge;

said inner periphery of said ring-shaped plate and said columnar protrusion extend into said frame from said lower surface to an area within said frame midway between said lower surface and said opening, so as to form a magnetic gap between said inner periphery of said ring-shaped plate and said outer periphery of said columnar protrusion;

at least a portion of said voice coil is movably disposed inside of said magnetic gap; and said inner periphery of said suspension holder and said inner periphery of said diaphragm are fixed to a portion of said voice coil which is outside of said magnetic gap.

2. The speaker of claim 1, wherein said inner periphery of said suspension holder and said inner periphery of said diaphragm are directly fixed to said portion of said voice coil which is outside of said magnetic gap.

3. The speaker of claim 1, wherein said inner periphery of said suspension holder and said inner periphery of said diaphragm are indirectly fixed to said portion of said voice coil which is outside of said magnetic gap.

4. The speaker of claim 1, wherein said ring-shaped magnet is disposed below said lower surface of said frame; and said outer periphery of said ring-shaped magnet extends at least beyond an outer periphery of said second edge.

5. The speaker of claim 1, wherein said magnetic circuit further comprises a plate-shaped top plate laminated on said columnar protrusion of said yoke.

6. The speaker of claim 5, wherein said ring-shaped magnet is disposed below said lower surface of said frame; and said outer periphery of said ring-shaped magnet extends at least beyond an outer periphery of said second edge.

7. The speaker of claim 1, wherein a lower part of a side surface of said frame includes a step section for receiving said second edge, and an air vent disposed below said step section.

8. The speaker of claim 7, further comprising a dust filter disposed in said air vent.

9. The speaker of claim 8, wherein said dust filter is disposed outside of said frame.

* * * * *